US006984122B2

(12) United States Patent
Sullivan et al.

(10) Patent No.: US 6,984,122 B2
(45) Date of Patent: Jan. 10, 2006

(54) COMBUSTION CONTROL WITH TEMPERATURE COMPENSATION

(75) Inventors: John D. Sullivan, Fremont, CA (US); Luis H. Morales, San Jose, CA (US); Robert W. Nickeson, Pleasanton, CA (US)

(73) Assignee: Alzeta Corporation, Santa Clara, CA (US)

( * ) Notice: Subject to any disclaimer, the term of this patent is extended or adjusted under 35 U.S.C. 154(b) by 0 days.

(21) Appl. No.: 10/423,680

(22) Filed: Apr. 25, 2003

(65) Prior Publication Data

US 2004/0214120 A1 Oct. 28, 2004

(51) Int. Cl.
*F23N 3/00* (2006.01)

(52) U.S. Cl. ..... 431/89; 431/18

(58) Field of Classification Search ..... 431/89, 431/18, 60, 90, 37

See application file for complete search history.

(56) References Cited

U.S. PATENT DOCUMENTS 4,249,886 A * 2/1981 Bush ..... 431/90
4,613,072 A * 9/1986 Kikuchi et al. ..... 237/12.3 C
5,277,134 A * 1/1994 Schlessing et al. ..... 110/188
6,095,793 A * 8/2000 Greeb ..... 431/12

* cited by examiner

*Primary Examiner*—Alfred Basichas
(74) *Attorney, Agent, or Firm*—DLA Piper Rudnick Gray Cary US LLP

(57) ABSTRACT

Combustion control systems for maintaining a selected fuel-air ratio for a combustion apparatus supplied with air at a substantially constant volumetric rate are improved by means for adjusting the flow rate of fuel in relation to temperature fluctuations of the air. A temperature sensor positioned in the air stream before it mixes with the fuel is connected to a converter which transmits converted temperature signals from the sensor as adjustments of a remote control-flow regulator in the fuel line or in the air stream. Thus, if the flow regulator is in the fuel line, a drop in air temperature will cause an increase of the fuel flow rate. Conversely, a rise in air temperature will result in a reduced fuel flow rate. If the flow regulator is in the air stream, a drop in air temperature will cause a decrease in the air flow rate, while a rise in air temperature will result in increased air flow rate. The invention is also applicable to temperature variations of the fuel by using the three basic components: a temperature sensor, a converter and a remote control-flow regulator.

13 Claims, 4 Drawing Sheets

COMBUSTION CONTROL WITH TEMPERATURE COMPENSATION

BACKGROUND OF THE INVENTION

This invention relates to combustion control directed to maintaining fuel efficiency and minimal emissions of air pollutants, especially nitrogen oxides ($NO_x$). More particularly, the invention provides a combustion control system to maintain a selected fuel-air ratio that is improved in that density changes of a reactant, usually air, caused by temperature variations, are compensated for.

Two types of combustion control systems are commonly used (both illustrated in FIGS. 1 and 2 hereof). One is known as the "jack-shaft" or "single-point" positioning system, and the other as a "two-point parallel" system. U.S. Pat. No. 4,249,886 to Bush discusses both types of combustion control systems and proposes modification of the linkage that controls fuel and air flow. The modified linkage is intended to change the air flow in relation to any desired changes in fuel flow. However, the Bush control system fails to compensate for temperature changes in the reactants, principally significant temperature swings of air which obviously change air density and thus cause the fuel-air ratio to vary from the desired or target ratio.

A principal object of this invention is to provide an improved combustion control system that in response to temperature changes of the reactants, usually air alone, automatically varies the flow of fuel or air to maintain a substantially constant target fuel-air ratio.

Another object is to minimize the use of mechanical linkages in the control system.

These and other features and advantages of the invention will be apparent from the description which follows.

SUMMARY OF THE INVENTION

Basically, the invention incorporates in current combustion control systems means for measuring temperature variations of the air stream and for automatically causing the variations to adjust the flow of fuel or air to maintain a target fuel air ratio. In one embodiment of the invention, known combustion control systems are improved by the placement of a flow regulator in the fuel or air supply line in series with the usual flow regulator of that line. This additional flow regulator is remotely operated in combination with, and in relation to, temperature responsive means that monitor the air stream temperature.

The additional flow regulator that is remotely operated can be a valve or damper that is operated electrically, pneumatically or hydraulically. Such choices of the additional flow regulator are intended in the term, "remote control-flow regulator", used hereinafter.

BRIEF DESCRIPTION OF THE DRAWINGS

To facilitate further description and understanding of the invention, reference will be made to the accompanying drawings of which.

DESCRIPTION OF PREFERRED EMBODIMENTS

Figure 1:
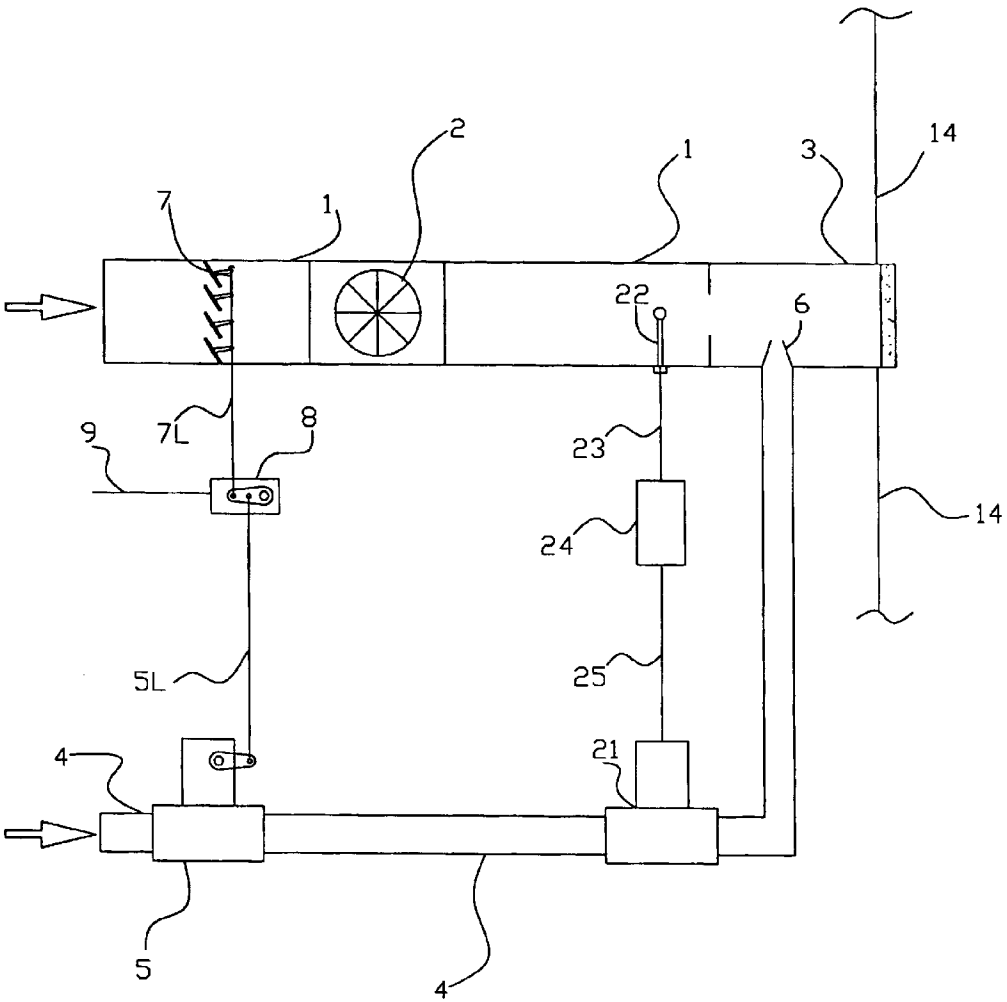
FIG. 1 is a schematic representation of the known "single-point" positioning control system as improved by the invention.

FIG. 1 shows a combustion control system comprising an air supply duct 1 with blower 2 feeding burner 3. Fuel supply line 4 with control valve 5 discharges fuel through nozzles 6 into burner 3 to form a uniform fuel-air mixture before exiting burner 3 and undergoing combustion. Partial line 14 represents a wall of a furnace into which burner 3 discharges the burning mixture. The flow of air to blower 2 is regulated by damper 7 which is moved by mechanical linkage 7L to mechanical actuator 8 that responds to firing rate signals received through line 9. Valve 5 is also operated by mechanical linkage 5L connected to actuator 8. This system, as thus far described, is essentially the common "jack-shaft" or "single-point" positioning system.

The invention as applied to FIG. 1 to compensate for density variations of the air supply stream resulting from temperature fluctuations comprises the insertion of a remote control-flow regulator, specifically, preferred electrically operated valve 21 in fuel supply line 4 in series with valve 5. Temperature sensor 22 in air duct 1 near burner 3 passes temperature signals through line 23 to converter 24 that through line 25 electrically controls the operation of valve 21. The components of the invention act thus: when the air temperature drops, valve 21 will adjust for greater flow of fuel to compensate for the flow of denser air, but, when the air temperature rises, valve 2 will adjust for lesser flow of fuel. Thus, the addition of components 21 to 25 improve the maintenance of the selected fuel-air ratio by compensating for temperature variations of the air stream which cause air density variations that would, in the absence of the invention, make the fuel-air ratio depart from the selected or target value. Deviations from the target value mean loss of fuel efficiency and increased air pollution. Valve 21 is shown in FIG. 1 downstream of valve 5, but, optionally, can be placed upstream of valve 5.

Figure 2:
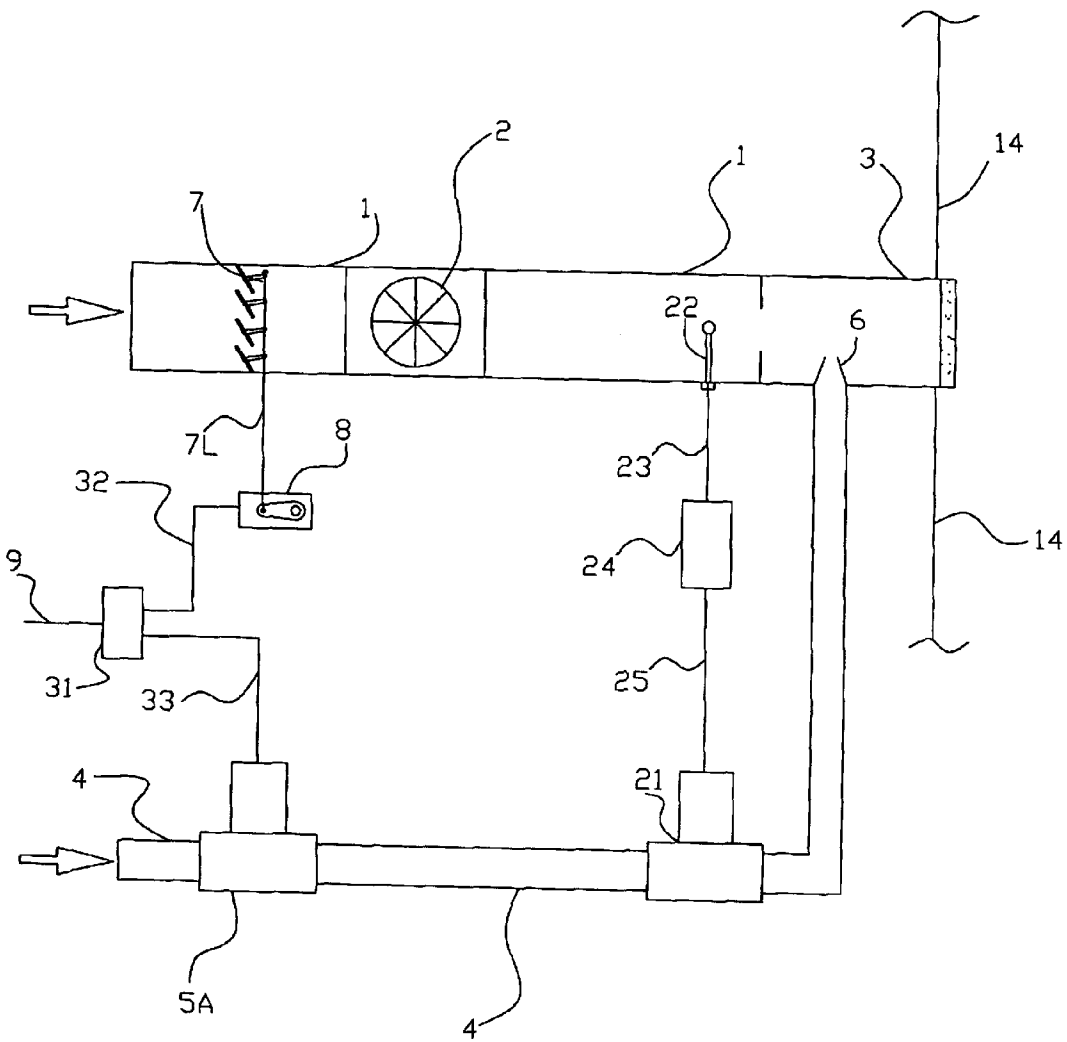
FIG. 2 is a similar representation of the "two-point parallel" positioning control system that is made more accurate by the invention.

In FIG. 2 the combustion control system again comprises air duct 1, blower 2 and burner 3. Fuel supply line 4 with motor-operated control valve 5B passes fuel through line 4 and nozzles 6 into burner 3 to mix thoroughly with air prior to issuing from burner to support combustion. Partial line 14 represents a wall of a furnace into which burner 3 discharges the burning mixture. A firing rate signal continuously passes through line 9 to microprocessor-based controller 31 that, through line 32, causes motor 8 to move damper 7 through mechanical linkage 7L. Simultaneously, controller 31 through line 33 causes motorized valve 5A to adjust the flow of fuel through line 4 toward nozzles 6. This system, as thus far described, is basically the known "two-point parallel" positioning system.

To make the "two-point parallel" positioning system more accurate by adjusting for air density variations caused by air temperature changes, the invention provides the insertion of a remote control-flow regulator, specifically, electrically operated valve 21 in fuel supply line 4 downstream (optionally can be upstream) of valve 5A as well as the addition of temperature sensor 22 in air duct 1 near burner 3. Sensor 22 passes temperature variation signals through line 23 to converter 24 that electrically controls the operation of valve 21. Thus, when the air temperature drops, valve 21 will adjust for greater flow of fuel to compensate for the flow of denser air and will adjust conversely when air temperature rises. Accordingly, the invention of modulating fuel flow in relation to air temperature variations ensures the maintenance of a fuel-air ratio that is continuously closer to a selected target value than was heretofore possible.

Figure 3:
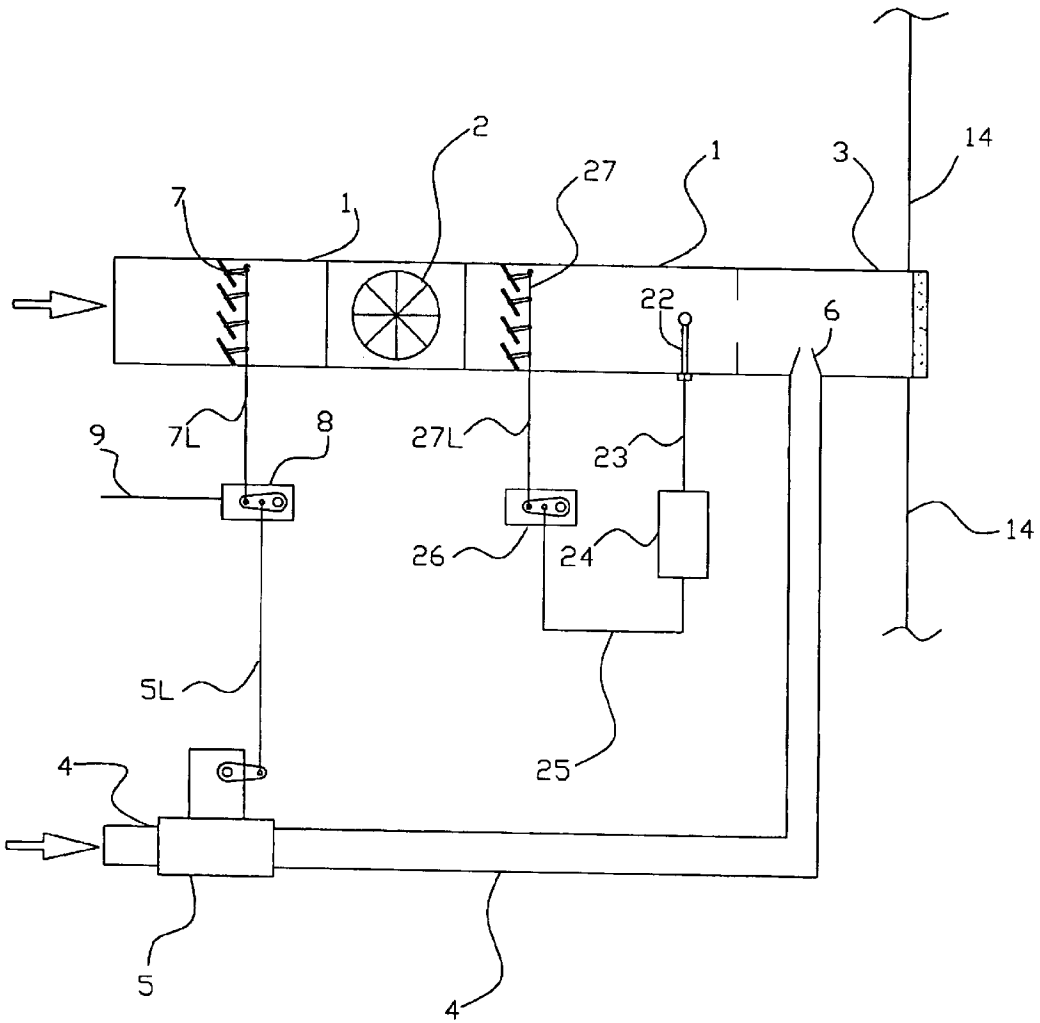
FIG. 3 is like FIG. 1 but shows an alternate application of the invention to the "single-point" positioning control system.

FIG. 3 differs from FIG. 1 in that air flow is further controlled in accordance with the invention as an alternate to further controlling fuel flow shown in FIG. 1. Temperature sensor 22 in FIG. 3 sends signals through line 23 to converter 24 that through line 25 electrically operates motor 26 which moves damper 27 in air line 1 by mechanical linkage 27L.

Figure 4:
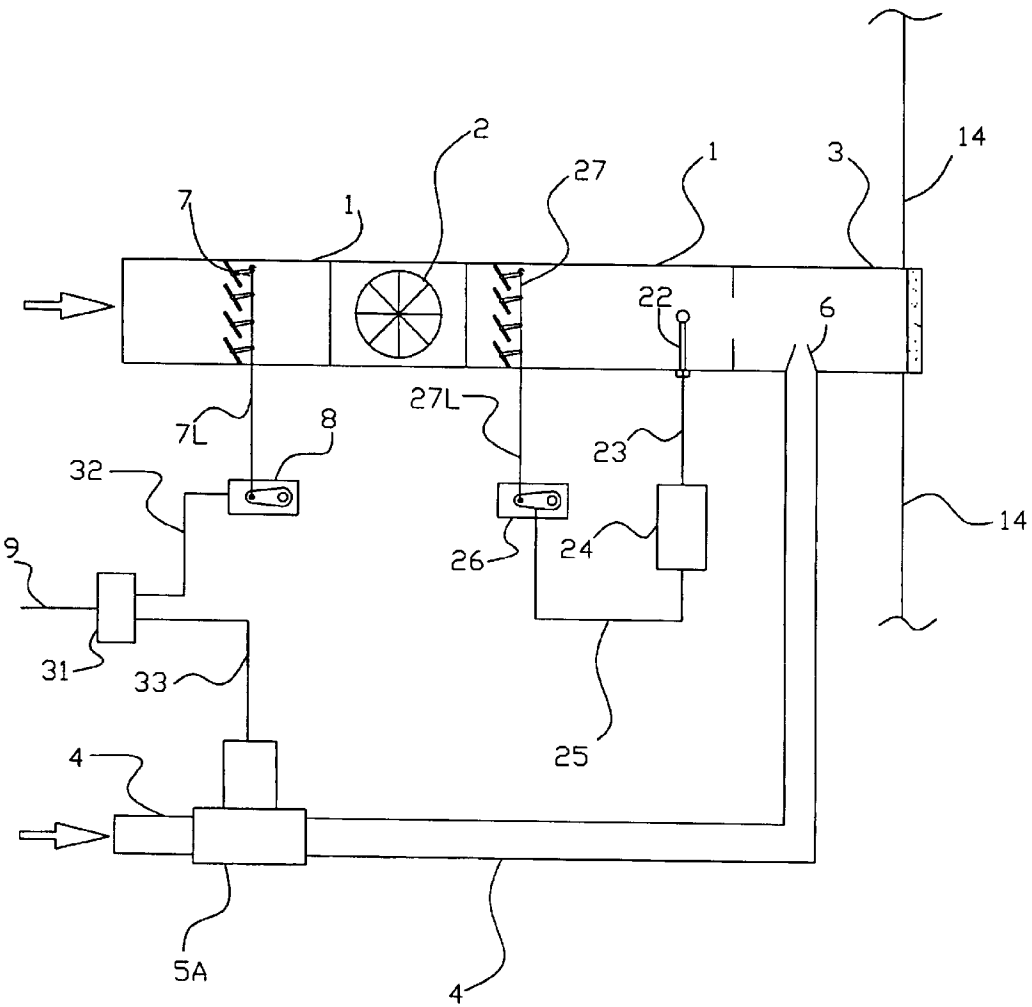
FIG. 4 is like FIG. 2 but shows an alternate application of the invention to the "two-point parallel" positioning control system.

Similarly, FIG. 4 differs from FIG. 2 in that air flow is further controlled instead of further control of fuel flow shown in FIG. 2. FIG. 4 shows the same components, 22 to 27, of FIG. 3 to further control the air flow as air temperature fluctuates.

In both FIGS. 3 and 4, damper 27 may be replaced by a valve, e.g., butterfly type, and damper 27 or valve may be positioned upstream of damper 7 and anywhere in line 1 before the air mixes with the fuel. As previously noted, damper 27 or a valve in line 1 may be operated electrically, pneumatically or hydraulically in lieu of mechanical linkage 27L shown in FIGS. 3 and 4.

The term, "remote control-flow regulator", is used herein to mean a device such as a valve or damper that is operated electrically or pneumatically or hydraulically. An electrically operated device is usually preferred for simplicity.

Of course, combustion systems use excess air to ensure complete combustion of the fuel, and importantly in lean-premixed burners, to lower the combustion temperature to minimize $NO_x$ formation. Excess air is conventionally defined as the amount of air that is in excess of the stoichiometric requirement of the fuel with which it is mixed. Good practice calls for excess air that is 15% or greater. In lean-premixed burners operating at 9 ppm (parts per million on a volumetric basis) or lower $NO_x$ emissions, the excess air level may be 65% or higher. Most of the excess air in the lean-premixed burners serves to lower the combustion temperature and hence its oxygen content acts as an inert like nitrogen to lower combustion temperature.

In as much as flue gas is warmer than air, it is thermally more efficient to recirculate some flue gas in place of some of the excess air in high-excess-air burners. This can be done as long as the oxygen-depleted flue gas is not mixed with air in a proportion that makes the mixture have insufficient oxygen for complete combustion of the fuel. Theoretically, the mass of the fresh air in an air-plus-flue-gas mixture must therefore be sufficient to provide 15% excess oxygen in the fully combusted products in order to be consistent with standard combustion practice.

Once the minimum oxygen requirements for complete combustion are met, any additional mass flow in the air-plus-flue-gas mixture can be inert (no oxygen) and still achieve the desired affect in the low-$NO_x$ burner of lowering the flame temperature. A typical air-plus-flue-gas stream could therefore be comprised of 100% stoichiometric air, 15% excess air, and flue products that have a mass that is equal to 40% of the total air flow. The total mass flow of this air-plus-flue-gas stream would be equivalent to a "61% excess air" fresh-air-only stream, and would therefore have similar flame-cooling capacity. The benefit of operating with 15% excess air and 40% recirculated flue gas, instead of 61% excess air, is higher thermal efficiency because of the heat in the flue gas.

Recirculated flue gas is commonly used in combustion systems with firing rates in excess of about 0.5 MBTU/hr (million British Thermal Units per hour). Obviously, the temperature and quantity of recirculated flue gas can cause wide temperature variations of the stream that is mixed with the fuel prior to combustion. Therefore, the invention is particularly valuable in such cases by maintaining substantially constant the fuel-air ratio that was selected for thermal efficiency and low $NO_x$ emissions.

An example of the invention as applied to the two-point parallel positioning system of FIG. 2 for the burner of a watertube boiler with a maximum firing rate of 8.4 MBTU/hr involved the following specific hardware for the control components added to the system pursuant to the invention:

For sensor 22: one-eighth inch diameter by 6 inch long undergrounded K-type Therm-X thermocouple;

For converter 24: Siemens RWF40 Universal Digital Controller that converts K-type thermocouple signals into 4–20 milliamp signals that drive valve 21; and For valve 21: 3 inch diameter NPT Eclipse butterfly valve with undersized (2.875 inch diameter) disk, actuated by a Honeywell M7284C Modutrol motor.

The fuel was natural gas (985 BTU per cubic foot) and an air-plus-flue-gas mass flow equivalent to 65% excess air was selected to achieve the desired low $NO_x$ emissions. The actual air-plus-flue gas mixture was allowed to vary between 65% excess air and no flue gas (as the excess air only condition) and 20% excess air and 37% flue gas (as the high flue gas recirculation condition). At 65% excess air or equivalent air-plus-flue-gas mass flow, the Alzeta CSB burner (a porous surface combustion burner) used in this example is known to yield not more than 9 ppm $NO_x$ emissions. The temperature of the air stream (including recirculated flue gas) varied between 50° F. to 200° F. as the fresh combustion air flow was decreased and the flue gas flow was increased. $NO_x$ emissions (corrected to standard 3% stack oxygen) were maintained at a level between 5 and 9 ppm.

Based on experience, without valve 21 and associated components, it is known that an air temperature swing from 50° F. to 200° F. would have caused a 29% decrease in the mass flow of the air-plus-fuel-gas stream and a 29% increase in the mass ratio of fuel to air-plus-flue-gas. Due to the very tight control requirements of ultra-low-$NO_x$ burners, this change in fuel to air-plus-flue-gas mass ratio would have resulted in unacceptably high $NO_x$ emissions.

Similarly, if the burner was tuned to operate properly at the 200° F. air-plus-flue-gas temperature, then a decrease in temperature to 50° F. would have caused a 29% increase in air-plus-flue-gas flow, and 29% decrease in the mass ratio of fuel to air-plus-flue-gas, and a probable loss of burner stability.

With valve 21 and associated components installed, the secondary fuel flow control valve partially closed to decrease fuel flow when the air-plus-flue-gas temperature increased, and partially opened when the air-plus-flue-gas temperature decreased. The change in mass flow ratio of the fuel to oxidizer stream over the full range of operation was less than plus or minus 5%. Good flame stability and sub 9 ppm $NO_x$ emissions were achieved over the full range of operation.

Microprocessor-based controller 31 in the two-point parallel positioning system of FIG. 2 is supplied by manufacturers such as Honeywell and Siemens with a capability of controlling up to four stream actuators simultaneously. Therefore, the flow of fuel and air regulated by controller 31 in FIG. 2 can be supplemented with the controlled flow of one or two additional streams supplied to the burner. For example, recirculated flue gas can be introduced into the air stream through a remote control valve that is operated by controller 31. Similarly, an auxiliary stream of fuel can be supplied to the burner through a remote control valve that is operated by controller 31. Such additional stream controls in a two-point parallel positioning system do not alter the fact that the two-point parallel positioning system is still present and intact. Hence, claims referring to a two-point parallel positioning system are intended to protect the system even when another stream control has been added thereto.

Those skilled in the art will visualize variations and modifications of the invention without departing from the spirit or scope of the invention. For example, if it were desired to compensate also for temperature changes of the fuel, a temperature sensor would be placed in fuel line 4 and means for varying air (with or without flue gas) flow would be operated by a converter 24 that converts thermocouple signals from the temperature sensor in line 4 into a current that drives the means for varying air flow. The means for varying the air flow may be another damper like damper 7 or a valve, e.g., a butterfly valve, in air line 1 in series with damper 7. If temperature compensation of only fuel is desired, components 21 to 25 can be eliminated. A temperature sensor in fuel line 4 acting with a converter 24 and a flow regulator in air line 1 would cause the air flow to increase as the fuel temperature drops and to decrease air flow as fuel temperature rises. In short, such air flow changes are the opposites of those occurring when air temperature is monitored. Another way of compensating for fuel temperature variations is to place a temperature sensor in fuel line 4 and to pass temperature signals from the sensor to a converter that modulates the flow of fuel through an electrically operated, added valve in fuel line 4. With this arrangement of sensor, converter and added valve, a decrease in fuel temperature will cause the added valve to decrease fuel flow, while an increase in fuel temperature will result in increased fuel flow. While the example of the invention used natural gas and a porous surface combustion burner selected for achieving minimal $NO_x$ emissions, the invention is applicable to any combustion operation using any liquid or gaseous fuel and any type of flame or flameless burner. In view of the frequent use of recirculated flue gas, the mention in the claims of air, that is monitored for temperature variations, means air with or without recirculated flue gas. Accordingly, only such limitations should be imposed on the invention as are set forth in the appended claims.

What is claimed is:

1. A combustion control system for maintaining a selected fuel-air ratio for a combustion apparatus supplied with an air stream at a substantially constant volumetric rate, said system comprising:

a. remote control-flow regulator in the fuel line;

b. a temperature sensor in the air stream before it mixes with said fuel; and c. a converter connected to receive temperature signals from said sensor and connected to said remote control-flow regulator, wherein said converter controls said remote flow-control regulator based on the temperature signals to adjust a flow rate of fuel in relation to temperature fluctuations of said air to maintain said selected fuel-air ratio.

2. The combustion control system of claim 1 wherein the remote control-flow regulator is an electrically or pneumatically or hydraulically operated valve in the fuel line.

3. The combustion control system of claim 2, wherein the combustion control system comprises a single-point combustion control system or a two-point parallel combustion control system.

4. In a single-point combustion control system or a two-point parallel combustion control system for maintaining a selected fuel-air ratio for a combustion apparatus supplied with an air stream at a substantially constant volumetric rate, the improvement comprising:

a. a remote control-flow regulator in the fuel line;

b. a temperature sensor positioned in the air stream before it mixes with said fuel; and c. a converter connected to receive temperature signals from said sensor and connected to said remote control-flow regulator, wherein said converter controls said remote flow-control regulator based on the temperature signals to adjust a flow rate of fuel in relation to temperature fluctuations of said air to maintain said selected fuel-air ratio.

5. The improvement of claim 4 wherein the remote control-flow regulator is electrically or pneumatically or hydraulically operated.

6. The improvement of claim 4 wherein the remote control-flow regulator is an electrically operated valve in the fuel line.

7. In a combustion process wherein an air stream is supplied at a substantially constant volumetric rate and a single-point combustion control system or a two-point parallel combustion control system serves to adjust by means of a valve the flow rate of fuel to maintain a selected fuel-air ratio at varying firing rates, the improvement of compensating for air temperature fluctuations, which comprises modulating the flow rate of said fuel with a remote control-flow regulator, sensing the temperature of the air stream, and converting sensed temperature fluctuations into adjustments of said remote control-flow regulator to control the flow rate of fuel in relation to the air temperature fluctuations, thereby maintaining the selected fuel-air ratio.

8. The improvement of claim 7 wherein the remote control-flow regulator is electrically or pneumatically or hydraulically operated.

9. The improvement of claim 7 wherein the remote control-flow regulator is an electrically operated valve in the fuel line.

10. In a combustion process wherein an air stream is supplied at a substantially constant volumetric rate and a single-point combustion control system or a two-point parallel combustion control system serves to adjust by means of a valve the flow rate of fuel to maintain a selected fuel-air ratio at varying firing rates, the improvement of compensating for fuel temperature fluctuations, which comprises modulating the flow rate of said air stream or said fuel with a remote-control flow regulator, sensing the temperature of said fuel, and converting sensed temperature fluctuations into adjustments of said remote-control flow regulator.

11. The improvement of claim 10 wherein the remote control-flow regulator is electrically or pneumatically or hydraulically operated.

12. The improvement of claim 10 wherein the remote control-flow regulator is an electrically operated damper in the air stream.

13. The improvement of claim 10 wherein the remote control-flow regulator is an electrically operated valve in the fuel line.

* * * * *